US011319194B2

(12) United States Patent
Seaman et al.

(10) Patent No.: US 11,319,194 B2
(45) Date of Patent: May 3, 2022

(54) PIPELAYER AND DIESEL HYBRID PIPELAYER POWER CONTROL STRATEGY

(71) Applicant: Caterpillar Inc., Peoria, IL (US)

(72) Inventors: Codey R. Seaman, Washington, IL (US); David D. Tallon, Washington, IL (US)

(73) Assignee: Caterpillar Inc., Peoria, IL (US)

( * ) Notice: Subject to any disclaimer, the term of this patent is extended or adjusted under 35 U.S.C. 154(b) by 99 days.

(21) Appl. No.: 16/688,860

(22) Filed: Nov. 19, 2019

(65) Prior Publication Data

US 2021/0147196 A1 May 20, 2021

(51) Int. Cl.
*B66C 23/40* (2006.01)
*B66C 13/18* (2006.01)
*B66C 23/76* (2006.01)

(52) U.S. Cl.
CPC ..... *B66C 23/40* (2013.01); *B66C 13/18* (2013.01); *B66C 23/76* (2013.01)

(58) Field of Classification Search
CPC ..... B66C 23/40; B66C 23/44; B66C 23/76; B66C 13/18
USPC ..... 180/65.29, 68.5
See application file for complete search history.

(56) References Cited

U.S. PATENT DOCUMENTS 6,688,481 B1 2/2004 Adner et al.
8,857,635 B2 10/2014 Weckbecker et al.
9,511,833 B2 12/2016 Scott et al.
2007/0072063 A1* 3/2007 Imashige ..... B62D 25/10 429/96
2009/0283346 A1* 11/2009 Katae ..... B66F 9/07572 180/68.2
2011/0147104 A1* 6/2011 Ogawa ..... B66F 9/07531 180/65.22
2012/0285757 A1* 11/2012 Atarashi ..... E02F 9/18 180/68.1
2015/0139768 A1* 5/2015 Egawa ..... B66C 23/74 414/719
2018/0258899 A1* 9/2018 Ikiyama ..... F02N 11/0822
2018/0266337 A1* 9/2018 Ikiyama ..... F02N 11/084
2019/0126716 A1* 5/2019 Kjille ..... B60H 1/00207
2021/0087026 A1* 3/2021 Caldwell ..... E02F 3/382
2021/0101788 A1* 4/2021 Caldwell ..... B66C 23/905

FOREIGN PATENT DOCUMENTS

CN 202089708 U 12/2011

* cited by examiner

*Primary Examiner* — Michael R Mansen
*Assistant Examiner* — Juan J Campos, Jr.
(74) *Attorney, Agent, or Firm* — Leydig, Voit & Mayer, Ltd.

(57) ABSTRACT

A pipelayer includes a frame, a plurality of ground engaging members movably supporting the frame, a prime mover, and a boom assembly and a counterbalance assembly supported on the frame. The boom assembly includes a boom. The counterbalance assembly including a counterweight, the counterweight being movably supported on the frame to counterbalance the boom assembly. The counterweight includes a battery box including at least one battery. A control strategy is also disclosed.

19 Claims, 6 Drawing Sheets

PIPELAYER AND DIESEL HYBRID PIPELAYER POWER CONTROL STRATEGY

TECHNICAL FIELD

This patent disclosure relates generally to pipelayers and, more particularly to a counterweight arrangement and power control strategy for a pipelayer.

BACKGROUND

Pipelayers are work machines used in pipelaying operations, in which the pipelayer raises, lowers, and carries heavy pipes. A counterbalance assembly is provided along an opposite side of the pipelayer to counterbalance the forces of a load being lifted via an opposing boom positioned along an opposite side of the pipelayer. The counterbalance assembly typically includes a counterweight that comprises a number of steel plates. The counterbalance assembly further includes a support structure that allows the counterweight to be is articulated to be moved relative to the machine frame in order to counteract a moment applied by the load lifted by the boom.

Pipelaying can be a lengthy process that can be dependent upon other operations occurring prior to or following a pipelayer positioning a length of pipe. During operation, pipelayers may spend as much as 75% of operational time idling for the comfort of the operator.

In U.S. Pat. No. 8,857,635, a large crane is provided with primary and secondary energy sources, the secondary energy source including an energy storage unit that may be utilized to power a crane cabin air-conditioning compressor. The secondary energy source may include a battery box that may be centrally disposed on the crane or as a base ballast or superlift counterweight on a separate counterweight carriage.

SUMMARY

The disclosure describes, in one aspect, a pipelayer including a frame, a plurality of ground engaging members movably supporting the frame, a prime mover, and a boom assembly and a counterbalance assembly supported on the frame. The boom assembly includes a boom. The counterbalance assembly including a counterweight, the counterweight being movably supported on the frame to counterbalance the boom assembly. The counterweight includes a battery box including at least one battery.

According to another aspect of the disclosure, there is provided a pipelayer including a frame, a plurality of ground engaging members movably supporting the frame, and a boom assembly and a counterbalance assembly supported on the frame. The boom assembly includes a boom. The counterbalance assembly includes a counterweight, the counterweight being movably supported on the frame to counterbalance the boom assembly. The pipelayer further includes a cab conditioning system, a first power source including an engine, a second power source including at least one battery, and a control system including at least one controller. The control system is configured to store a reference profile for the pipelayer, the reference profile including a lower battery power threshold. The at least one controller is configured to access the reference profile, determine a power level of the at least one battery, and compare the power level of the at least one battery to the lower battery power threshold. If the power level of the at least one battery is not less than the lower battery power threshold, the at least one controller is configured to operate at least the cab conditioning system from the second power source, and, if the power level of the at least one battery is less than the lower battery power threshold, the at least one controller is further configured to start the engine to recharge the at least one battery while operating at least the cab conditioning system.

In yet another aspect of the disclosure, there is provided a method of providing power to a cab conditioning system in a hybrid pipelayer including a frame supporting a cab, a boom assembly and a counterbalance assembly; the counterbalance assembly includes a movably supported counterweight to counterbalance the boom assembly; a plurality of ground engaging members movably support the frame; the pipelayer includes an ignition switch, the cab conditioning system, a first power source including an engine, and a second power source including at least one battery. The method includes determining a power level of the at least one battery, and comparing the power level of the at least one battery to a lower battery power threshold. The method further includes, if the power level of the at least one battery is not less than the lower battery power threshold, operating at least the cab conditioning system from the second power source, and, if the power level of the at least one battery is less than the lower battery power threshold, starting the engine to recharge the at least one battery while operating at least the cab conditioning system from the at least one battery.

BRIEF DESCRIPTION OF THE DRAWING(S)

DETAILED DESCRIPTION

Figure 1:
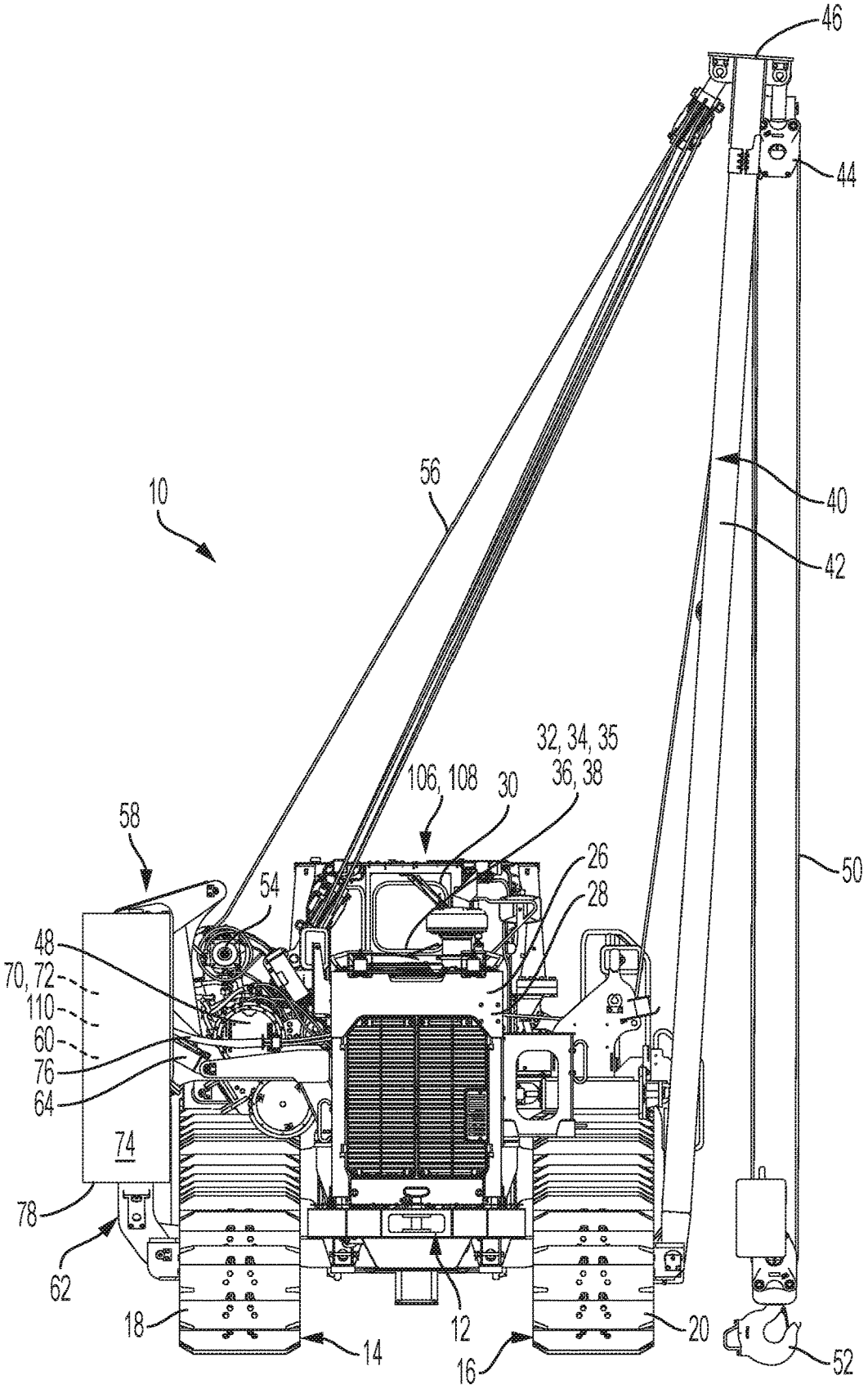
FIG. 1 illustrates a front elevational view of an exemplary pipelayer according to one embodiment of the present disclosure.
Figure 2:
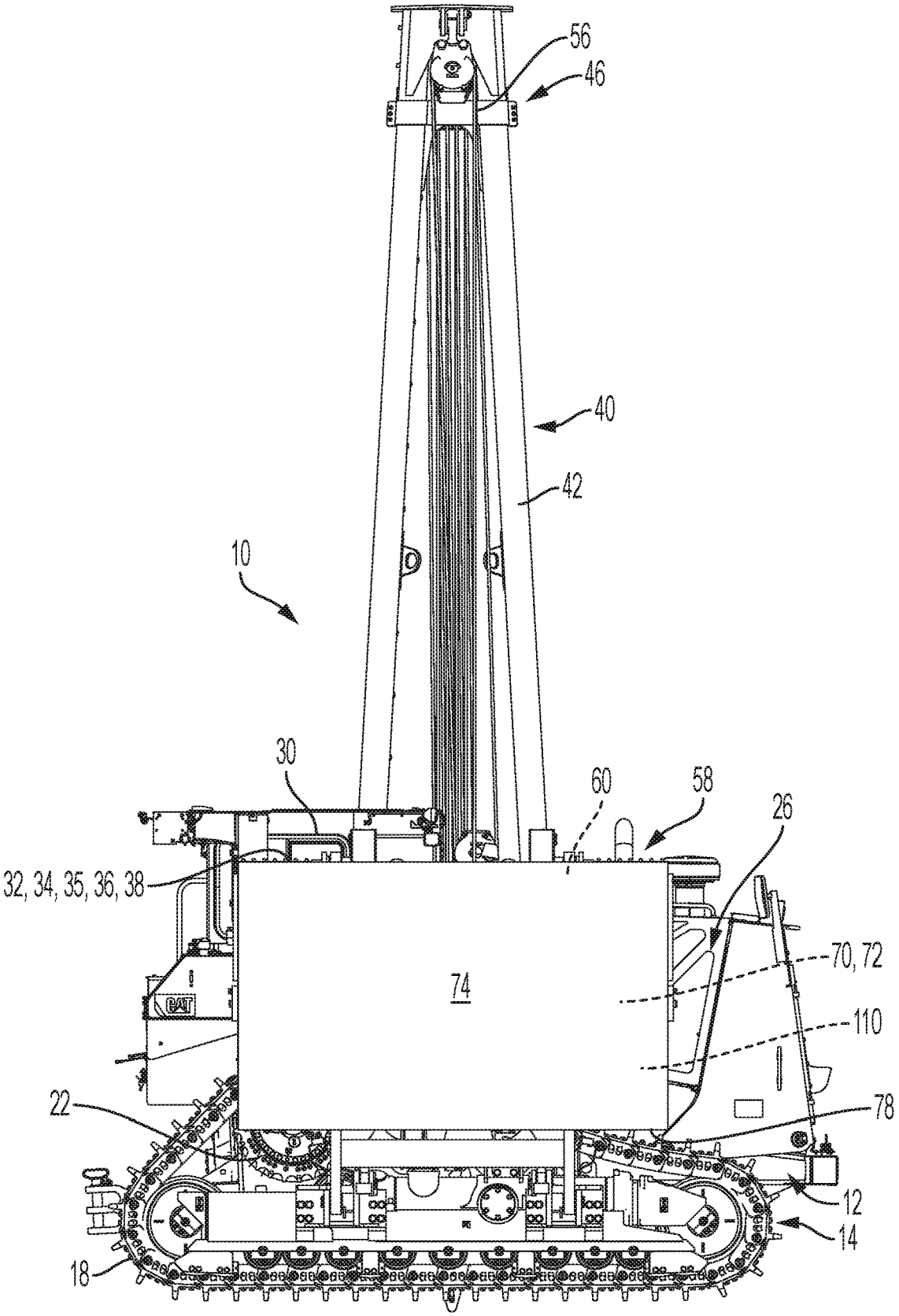
FIG. 2 is a side elevational view of the pipelayer of FIG. 1.
Figure 3:
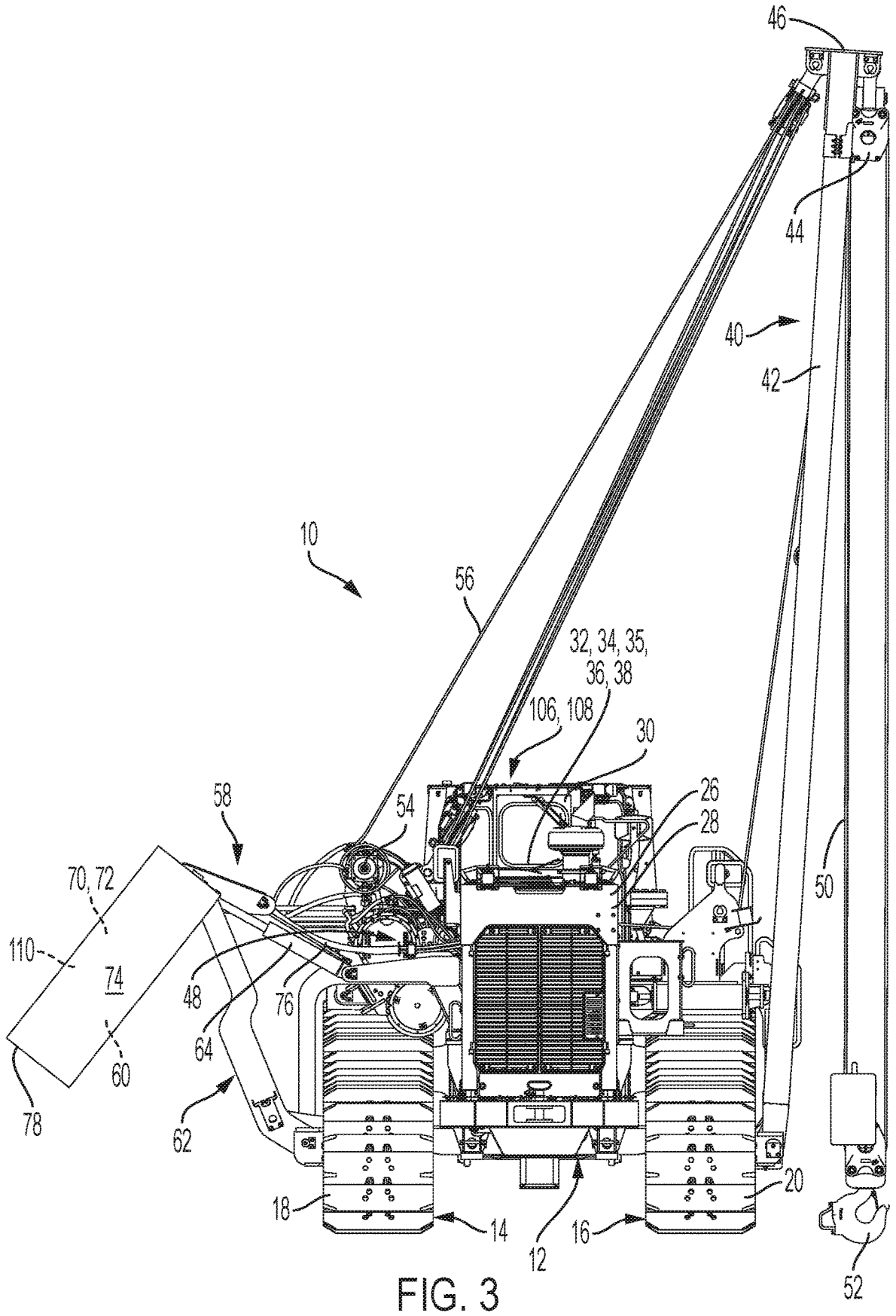
FIG. 3 is a front elevational view of the pipelayer of FIGS. 1 and 2 with a counterbalance assembly in an extended position.

This disclosure relates to a powertrain for a pipelayer 10, a hybrid control system, and cab conditioning control system for such a pipelayer 10. An exemplary pipelayer 10 is illustrated in FIGS. 1, 2, and 3. The pipelayer 10 includes a frame 12 supported on a plurality of ground engaging members 14, 16 configured for propelling the pipelayer 10 along a surface. In the illustrated embodiment, for example, the ground engaging members 14, 16 are track sections 18, 20 rotatably mounted by drive sprockets 22. The pipelayer 10 further includes a prime mover. The prime mover may be of any appropriate design, such as, for example, a first power source 24, such as an engine 26. In at least one embodiment, the engine 26 is a diesel engine. The ground engaging members 14, 16 may be coupled to the engine 26 by way of a drive train 28.

The pipelayer 10 further includes a cab 30, which may include one or more machine controls 32 and cab controls 34, which may control, for example, a machine ignition switch 35, electronic components 36 and cab conditioning systems 38, such as heating and air conditioning.

The pipelayer 10 further includes a boom assembly 40 mounted to the frame 12. Boom assembly 40 includes a boom 42 such as a lattice type boom. Boom assembly 40 may further include a pulley block 44 attached to a distal end 46 of boom 42, and a hook winch 48. A cable 50 may be attached to hook winch 48 and wound over pulley block 44. A hoist hook 52 may be suspended from cable 50. As such, a hoisted load (e.g. a pipe) hung by hoist hook 52 may be raised and lowered by winding and unwinding cable 50 around hook winch 48. Boom assembly 40 may also include a boom winch 54. A cable 56 may connect boom winch 54 to distal end 46 of boom 42, allowing the boom winch 54 to raise and lower boom 42 by winding and unwinding cable 56 around the boom winch 54. The hook winch 48 and the boom winch 54 may be any suitable type of rotary actuators known in the art, such as hydraulic or electric motors.

Pipelayer 10 may also include a counterbalance assembly 58 removably attached to frame 12. Counterbalance assembly 58 may include a counterweight 60 that is movably coupled to the frame 12 by a linkage assembly 62. The linkage assembly 62 may be of any appropriate design; for example, the linkage assembly 62 may be a four-bar linkage or a five-bar linkage. The linkage assembly 62 may be actuated by any appropriate arrangement to move the counterweight 60 from a retracted position, as illustrated in FIGS. 1 and 2, to an extended position, as illustrated in FIG. 3, or to any position between. For example, the linkage assembly 62 may be hydraulically controlled, as by one or more hydraulic cylinders 64. In operation, the hydraulic cylinder(s) 64 may be actuated to move the counterweight 60 between the extended and retracted positions. During operation of the boom assembly, the counterweight 60 may be extended to balance the hoisted load carried by hoist hook 52 by providing a counteracting moment that opposes a moment caused by the hoisted load of boom assembly 40. Each moment corresponds to each weight (hoisted load or counterweight 60) acting over a horizontal distance of that weight from a pipelayer center of gravity. The horizontal distance of counterweight 60 from the pipelayer center of gravity may be adjusted with an actuator, that is, the hydraulic cylinder(s) 64, in the illustrated embodiment, to produce a desired counteracting moment that opposes various moments caused by the hoisted load.

In accordance with aspects of this disclosure, the prime mover may further include a second power source 70 that includes at least one battery 72 as a source of electrical energy. Those of skill in the art will appreciate that the second power source 70 may include a plurality of batteries 72, however. In at least one embodiment, the battery 72 is disposed in a battery box 74 and positioned as the counterweight 60 of the counterbalance assembly 58, that is, at least a part of the counterweight 60. In at least one embodiment, the at least one battery 72 is sealed and able to rotate during operation of the pipelayer 10 and movement of the counterbalance assembly 58 without leaking contents of the battery 72. In at least one embodiment, the battery box 74 is a protective, waterproof structure that is resistant to the elements of an environment in which pipelayers typically operate. In at least one embodiment, the battery box 74 is metallic.

The at least one battery 72 is electronically coupled to the pipelayer 10 by battery cables disposed within one or more protective conduits 76. Those of skill in the art will appreciate that the conduit 76 may be disconnected from the battery 72 and/or the pipelayer 10 in order to facilitate replacement of the conduit 76 and/or the battery 72. The battery box 74 may additionally include a switch 78 that may be accessible to an operator or maintenance personnel from the ground.

Figure 4:
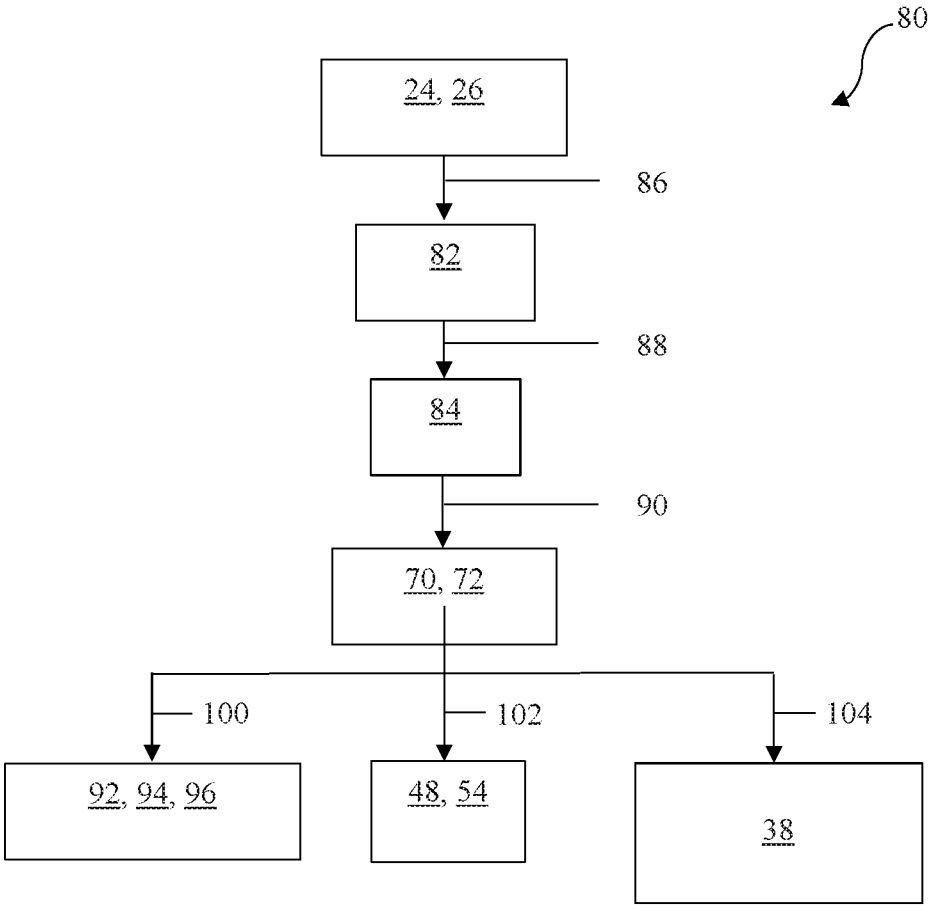
FIG. 4 is a schematic illustration of an exemplary powertrain according to teaching of the present disclosure for operation in the pipelayer of FIGS. 1-3.

The first and second power sources 24, 70 may utilized as a hybrid power system 80. An exemplary such hybrid power system 80 is schematically illustrated in FIG. 4. The first power source 24, which may be an engine 26, such as a diesel engine, may be utilized to create power, which is supplied to the second power source 70, that is, the at least one battery 72, by way of a generator 82 and an inverter 84. The engine 26, generator 82, and inverter 84 may be operatively coupled to one another and the second power source 70 by a plurality of electric cables 86, 88, 90.

The at least one battery 72 may then be utilized to provide full machine functionality or to power select operations of the pipelayer 10. For example, the at least one battery 72 may be utilized to power operations of the pipelayer 10 such as cab conditioning systems 38, and operation of one or both of the hook winch 48 and the boom winch 54. The at least one battery 72 may further be utilized to operate an electrical drive system 92 which may include one or more electric motors 94, 96 drivingly coupled to the ground engaging members 14, 16. The electric motors 94, 96 may be operatively connected to the drive sprockets 22, which drive tracks sections 18, 20. In an alternate embodiment including wheels (not illustrated), electric motors may be utilized to drive the wheels. It will further be appreciated that one or more additional electric motors may be provided in order to operate other components of the pipelayer 10, such as operation of the winches 48, 54. A plurality of electric cables 100, 102, 104 are provided to operatively connect the at least one battery 72 to the various machine operations.

The pipelayer 10 may include and aspects of the pipelayer 10 may be controlled by a machine control system 106 as shown generally by an arrow in FIG. 1 indicating association with the machine. The machine control system 106 may include an electronic control module or controller such as a controller 108 that controls the operation of various aspects of the pipelayer 10, including the hybrid power system 80. A reference profile of the pipelayer 10 may be stored within or accessed by the controller 108 or elsewhere within the machine control system 108. The reference profile may include a lower battery power threshold and a charged battery power threshold.

The controller 108 may be an electronic controller that operates in a logical fashion to perform operations, execute control algorithms, store and retrieve data and other desired operations. The controller 108 may include or access memory, secondary storage devices, processors, and any other components for running an application. The memory and secondary storage devices may be in the form of read-only memory (ROM) or random access memory (RAM) or integrated circuitry that is accessible by the controller 108. Various other circuits may be associated with the controller 108 such as power supply circuitry, signal conditioning circuitry, driver circuitry, and other types of circuitry.

The controller 108 may be a single controller or may include more than one controller disposed to control various functions and/or features of the control system 106. The term "controller" is meant to be used in its broadest sense to include one or more controllers and/or microprocessors that may be associated with the pipelayer 10 and that may cooperate in controlling various functions and operations and of the pipelayer 10. The functionality of the controller 108 may be implemented in hardware and/or software without regard to the functionality.

The pipelayer 10 may be equipped with a plurality of machine sensors that provide data indicative (directly or indirectly) of operating characteristics of the pipelayer 10. More specifically, the pipelayer 10 may include at least one battery charge sensor 110 which is indicative of a current state of charge of the at least one battery 72. The term "sensor" is meant to be used in its broadest sense to include one or more sensors and related components that may be associated with the pipelayer 10 and that may cooperate to sense or identify the state of charge of the at least one battery 72.

INDUSTRIAL APPLICABILITY

Figure 5:
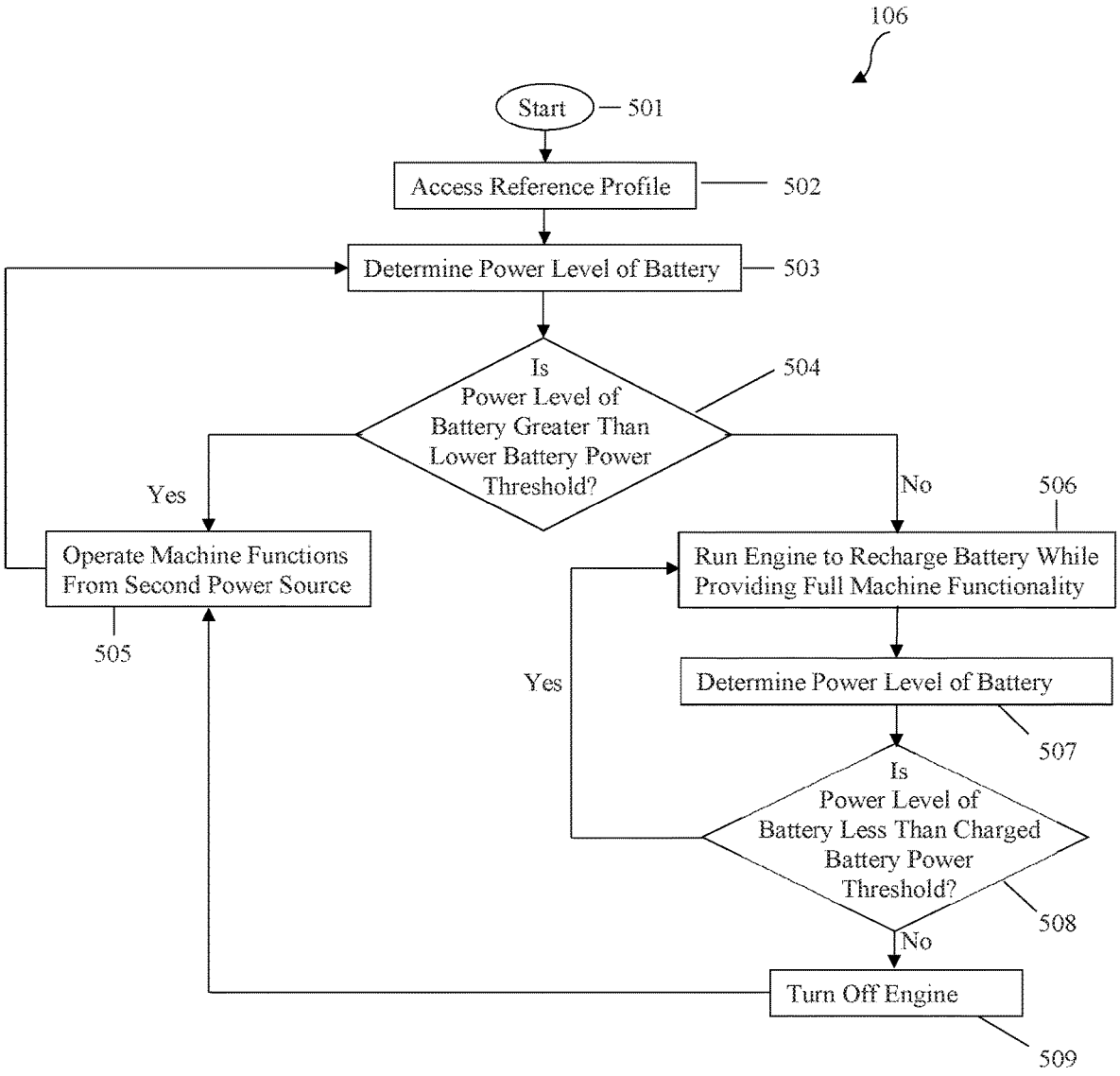
FIG. 5 is a flowchart illustrating operation of a hybrid control system for the exemplary powertrain of FIG. 4 and the pipelayer of FIGS. 1-3.
Figure 6:
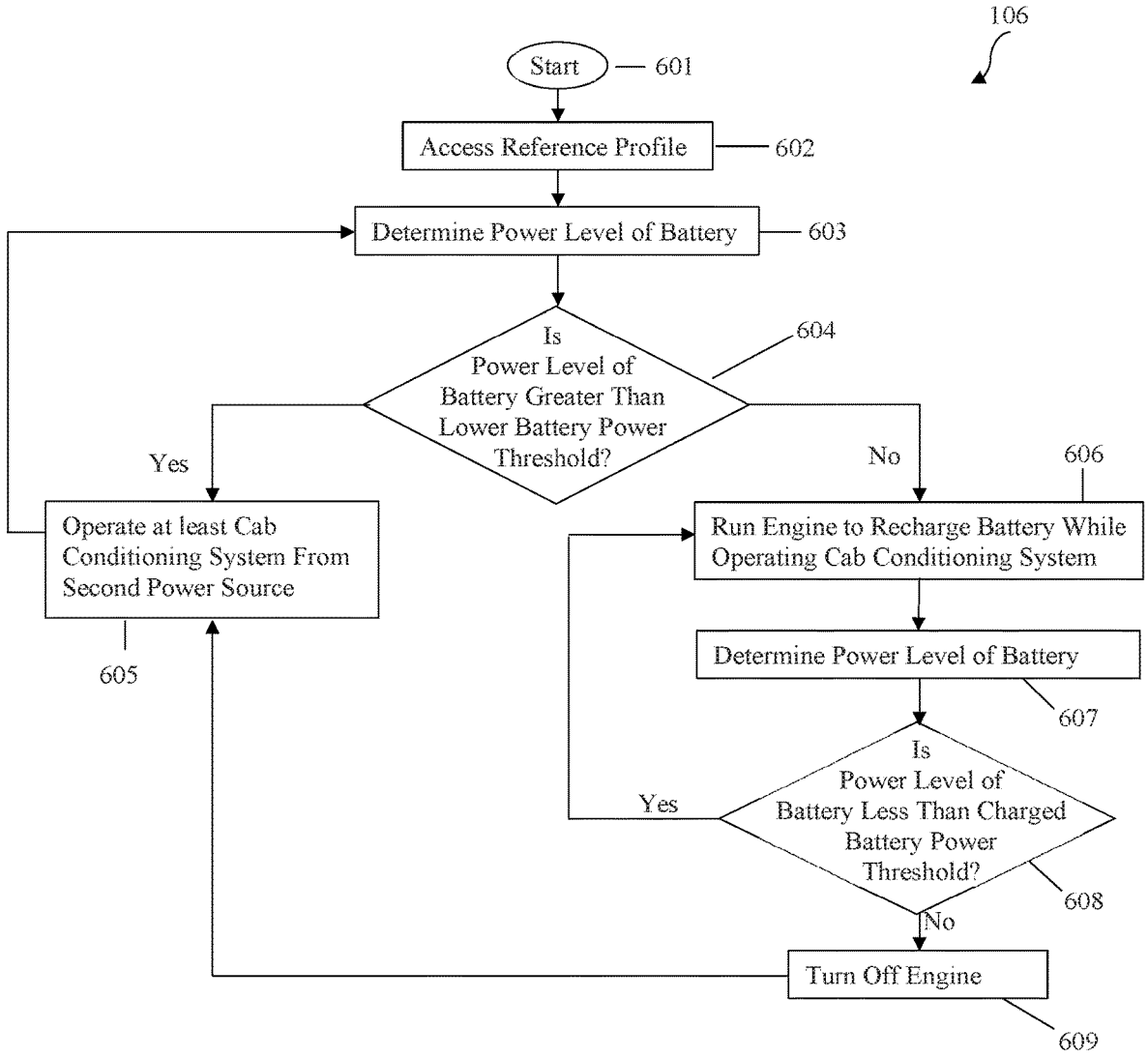
FIG. 6 is a flowchart illustrating operation of a conditioned cab control system for the exemplary powertrain of FIG. 4 and the pipelayer of FIGS. 1-3.

Exemplary systems and methods according to the present disclosure are graphically illustrated in the exemplary flowcharts of FIGS. 5-6. Referring first to FIG. 5, there is illustrated a machine control system 106 according to teachings of this disclosure. At Stage 501, the exemplary system is initiated when the machine ignition switch 35 is activated. At Stage 502, at least one controller 108 accesses the reference profile for the pipelayer 10. At Stage 503, the at least one controller 108 determines the power level of the at least one battery 72 based upon the battery charge sensor 110. At Stage 504, the at least one controller 108 determines whether the power level of the at least one battery 72 is greater than the lower battery power threshold. If the power level is greater than the lower battery power threshold, the machine functions of the pipelayer 10 are operated from the second power source 70 (Stage 505). This cycle of determining the power level of the at least one battery 72, and the comparison to the lower battery threshold repeats until such time as the power level of the at least one battery 72 falls below the lower battery power threshold.

When the at least one controller 108 determines that the power level of the at least one battery 72 has fallen below the lower battery power threshold at Stage 504, the runs the engine 26 to recharge the at least one battery 72, while providing full machine functionality (Stage 506). At Stage 507, the controller determines the power level of the at least one battery 72 based upon the battery charge sensor 110. At Stage 508, the at least one controller 108 determines whether the power level of the at least one battery 72 is less than the charged battery power threshold.

If the power level of the at least one battery 72 is less than the charged battery power threshold at Stage 508, the engine continues to run, returning the system to Stage 506. Stages 507 and 508 then repeat until such time as the power level of the at least one battery 72 is not less than the charged battery power threshold.

If the power level is not less than the charged battery power threshold at Stage 508, the machine functions of the pipelayer 10 are operated from the second power source 70, returning to Stage 505. The cycle of determining the power level of the at least one battery 72 at Stage 503, and the comparison to the lower battery threshold (Stage 504) repeats until such time as the power level of the at least one battery 72 again falls below the lower battery power threshold, at which time the controller 108 again runs the engine 26 (Stage 506).

This strategy may alternatively or additionally be applied as a method of powering a cab conditioning system 38 when a pipelayer 10 is idling for the comfort of an operator in the cab 30. Referring to FIG. 6, there is illustrated a machine control system 106 for providing power to limited operations of a pipelayer 10, such as the cab conditioning systems 38. At Stage 601, the exemplary system is initiated when the machine ignition switch 35 is activated. At Stage 602, at least one controller 108 accesses the reference profile for the pipelayer 10. At Stage 603, the at least one controller 108 determines the power level of the at least one battery 72 based upon the battery charge sensor 110. At Stage 604, the at least one controller 108 determines whether the power level of the at least one battery 72 is greater than the lower battery power threshold. If the power level is greater than the lower battery power threshold, the cab conditioning systems 38 of the pipelayer 10 are operated from the second power source 70 (Stage 605). This cycle of determining the power level of the at least one battery 72, and the comparison to the lower battery threshold repeats until such time as the power level of the at least one battery 72 falls below the lower battery power threshold.

When the at least one controller 108 determines that the power level of the at least one battery 72 has fallen below the lower battery power threshold at Stage 604, the controller 108 runs the engine 26 to recharge the at least one battery 72, while operating the cab conditioning systems 38 (Stage 606). At Stage 607, the controller 108 determines the power level of the at least one battery 72 based upon the battery charge sensor 110. At Stage 608, the at least one controller 108 determines whether the power level of the at least one battery 72 is less than the charged battery power threshold.

If the power level of the at least one battery 72 is less than the charged battery power threshold, (Stage 608), the engine 26 continues to run, returning the system to Stage 606. Stages 607 and 608 then repeat until such time as the power level of the at least one battery 72 is not less than the charged battery power threshold.

If the power level of the at least one battery 72 is not less than the charged battery power threshold at Stage 608, the cab conditioning systems 38 of the pipelayer 10 are operated from the second power source 70, returning to Stage 605. The cycle of determining the power level of the at least one battery 72 at Stage 603, and the comparison to the lower battery threshold (Stage 604) repeats until such time as the power level of the at least one battery 72 again falls below the lower battery power threshold, at which time the controller 108 again runs the engine 26 (Stage 606).

Accordingly, some embodiments of the disclosure may be useful in the operation of a pipelayer 10 at a worksite, particularly when the pipelayer 10 is idling. Some embodiments may reduce fuel consumption.

While aspects of the present disclosure have been particularly shown and described with reference to the embodiments above, it will be understood by those skilled in the art that various additional embodiments may be contemplated by the modification of the disclosed pipelayers, systems and methods without departing from the spirit and scope of what is disclosed. Such embodiments should be understood to fall within the scope of the present disclosure as determined based upon the claims and any equivalents thereof.

While the foregoing description provides examples of the disclosed system and technique, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

We claim:

1. A pipelayer comprising:

a frame;

a plurality of ground engaging members movably supporting the frame;

a prime mover;

a boom assembly supported on the frame, the boom assembly including a boom;

a counterbalance assembly supported on the frame, the counterbalance assembly including a counterweight, the counterweight being movably supported on the frame to counterbalance the boom assembly, wherein the counterweight includes a battery box including at least one battery; and a cab conditioning system and a control system including at least one controller, the control system being configured to store a reference profile for the pipelayer, the reference profile including a lower battery power threshold, the at least one controller being further configured to:

access the reference profile;

determine a power level of the at least one battery;

compare the power level of the at least one battery to the reference profile; and if the power level of the at least one battery is less than the lower battery power threshold, operate a first power source to recharge the at least one battery.

2. The pipelayer of claim 1 including at least the first power source and a second power source, the second power source including the at least one battery.

3. The pipelayer of claim 2 wherein the second power source includes a plurality of batteries.

4. The pipelayer of claim 3 wherein the battery box includes the plurality of batteries.

5. The pipelayer of claim 2 wherein the first power source includes an engine.

6. The pipelayer of claim 1 wherein the reference profile further includes a charged battery power threshold, and the at least one controller is further configured to discontinue operation of the first power source when the power level of the at least one battery is at least equal to the charged battery power threshold.

7. The pipelayer of claim 1 further including a machine ignition switch, wherein the at least one controller is operable when the machine ignition switch is activated.

8. The pipelayer of claim 1 wherein the at least one battery provides full machine functionality.

9. A pipelayer comprising:

a frame;

a plurality of ground engaging members movably supporting the frame;

a boom assembly supported on the frame, the boom assembly including a boom;

a counterbalance assembly supported on the frame, the counterbalance assembly including a counterweight, the counterweight being movably supported on the frame to counterbalance the boom assembly;

a cab conditioning system;

a first power source including an engine;

a second power source including at least one battery; and a control system including at least one controller, the control system being configured to store a reference profile for the pipelayer, the reference profile including a lower battery power threshold, the at least one controller being configured to:

access the reference profile, determine a power level of the at least one battery, compare the power level of the at least one battery to the lower battery power threshold, if the power level of the at least one battery is not less than the lower battery power threshold, operate at least the cab conditioning system from the second power source, and if the power level of the at least one battery is less than the lower battery power threshold, start the engine to recharge the at least one battery while operating at least the cab conditioning system.

10. The pipelayer of claim 9 wherein the reference profile further includes a charged battery power threshold, the at least one controller further being configured to:

determine the power level of the at least one battery when the engine is operating, compare the power level of the at least one battery to the charged battery power threshold, if the power level of the at least one battery is equal to or greater than the charged battery power threshold, discontinue operation of the engine and operate at least the cab conditioning system from the second power source, and if the power level of the at least one battery is less than the charged battery power threshold, continue to operate the engine to recharge the at least one battery.

11. The pipelayer of claim 9 wherein the at least one controller is configured to operate the pipelayer at full functionality from the second power source when the power level of the at least one battery is less than or greater than the lower battery power threshold.

12. The pipelayer of claim 9 wherein the at least one controller is configured to provide full machine functionality from the second power source while operating the first power source to charge the at least one battery.

13. The pipelayer of claim 9 wherein the at least one battery is disposed as at least a portion of the counterweight in the counterbalance assembly.

14. The pipelayer of claim 9 further including a machine ignition switch, and wherein the at least one controller is operational when the machine ignition switch is activated.

15. In a hybrid pipelayer including a frame supporting a cab, a boom assembly and a counterbalance assembly, the counterbalance assembly including a movably supported counterweight to counterbalance the boom assembly, a plurality of ground engaging members movably supporting the frame, an ignition switch, a cab conditioning system, a first power source including an engine, and a second power source including at least one battery, a method of providing power to the cab conditioning system, the method comprising:

determining a power level of the at least one battery, comparing the power level of the at least one battery to a lower battery power threshold, if the power level of the at least one battery is not less than the lower battery power threshold, operating at least the cab conditioning system from the second power source, and if the power level of the at least one battery is less than the lower battery power threshold, operating the engine to recharge the at least one battery while operating at least the cab conditioning system from the at least one battery.

16. The method of claim 15 further including determining the power level of the at least one battery when the engine is operating, comparing the power level of the at least one battery to a charged battery power threshold, if the power level of the at least one battery is less than the charged battery power threshold, continuing to operate the engine, if the power level of the at least one battery is not less than the charged battery power threshold, discontinuing operation of the engine and operating at least the cab conditioning system from the second power source.

17. The method of claim 15 further including operating the pipelayer at full functionality from the second power source.

18. The method of claim 15 further including determining the power level of the at least one battery when the ignition switch is activated.

19. The method of claim 15 further including disposing the at least one battery as at least a portion of the counterweight in the counterbalance assembly.

* * * * *